US010485288B2

(12) United States Patent
Pacheco

(10) Patent No.: US 10,485,288 B2
(45) Date of Patent: Nov. 26, 2019

(54) LIGHTED FOOTWEAR

(76) Inventor: Israel Junior Pacheco, Topeka, KS (US)

( * ) Notice: Subject to any disclaimer, the term of this patent is extended or adjusted under 35 U.S.C. 154(b) by 730 days.

(21) Appl. No.: 13/463,800

(22) Filed: May 3, 2012

(65) Prior Publication Data

US 2012/0285047 A1 Nov. 15, 2012

Related U.S. Application Data

(60) Provisional application No. 61/484,172, filed on May 9, 2011.

(51) Int. Cl.
*A43B 3/00* (2006.01)
*A43B 3/02* (2006.01)

(52) U.S. Cl.
CPC ..... *A43B 3/001* (2013.01); *A43B 3/0015* (2013.01); *A43B 3/02* (2013.01)

(58) Field of Classification Search
CPC ..... A43B 3/005; A43B 3/001; A43B 1/0036
USPC ..... 36/136, 137; 362/103
See application file for complete search history.

(56) References Cited

U.S. PATENT DOCUMENTS 1,524,049 A * 1/1925 Martin ..... 36/4
4,324,054 A * 4/1982 Rovinsky ..... 36/137
5,329,432 A * 7/1994 Bland ..... 362/103
5,673,502 A * 10/1997 Caterbone ..... 36/137
5,722,775 A 3/1998 Chien
5,732,486 A * 3/1998 Rapisarda ..... 36/137
5,813,148 A 9/1998 Guerra
5,815,955 A * 10/1998 Wu ..... 36/137
5,866,987 A * 2/1999 Wut ..... 315/119
5,970,633 A * 10/1999 Jones et al. ..... 36/136
6,238,055 B1 * 5/2001 Wallace ..... 362/103
6,293,032 B1 * 9/2001 Waits ..... 36/137
6,764,193 B1 * 7/2004 Wei ..... 362/103
7,510,293 B2 * 3/2009 Chyn ..... 362/103
7,614,166 B2 11/2009 Vick et al.
7,762,680 B1 * 7/2010 Miller et al. ..... 362/103
2002/0109981 A1 * 8/2002 Amici ..... 362/103
2004/0020077 A1 * 2/2004 Thomas et al. ..... 36/4
2004/0130887 A1 * 7/2004 Wei ..... 362/103
2005/0002179 A1 * 1/2005 Gonet ..... 362/103
2005/0286248 A1 * 12/2005 Weng ..... 362/276
2006/0007670 A1 * 1/2006 Chien ..... 362/103
2007/0041193 A1 * 2/2007 Wong et al. ..... 362/276
2007/0144040 A1 * 6/2007 Chen ..... 36/137
2007/0201221 A1 * 8/2007 Cherdak et al. ..... 362/103
2007/0236915 A1 * 10/2007 Chen ..... 362/103

(Continued)

*Primary Examiner* — Megan E Lynch

(57) ABSTRACT

Lighted footwear has a light disposed at a top portion of an upper of the footwear. The light is disposed to shine downward, ahead of a toe of the footwear. In one embodiment, lighted wading boots have one or more light emitting diodes (LEDs), emitting light of one or more frequencies, colors or intensities. The LED(s) are disposed in a waterproof light housing molded into a top portion of the upper of the wading boot. The LED(s) are disposed to shine downward, ahead of a toe of the boot. A waterproof battery compartment is molded into the top portion of the upper of the wading boot. A battery therein is operatively coupled to power the LED (s). A switch is disposed in a waterproof switch housing molded into a top portion of the upper of the wading boot to operatively coupled the battery and the LED(s) to control LED operation.

20 Claims, 5 Drawing Sheets

(56) References Cited

U.S. PATENT DOCUMENTS

| | | | | |
|---|---|---|---|---|
| 2008/0130269 | A1* | 6/2008 | Tseng | 362/103 |
| 2008/0253108 | A1* | 10/2008 | Ellenburg et al. | 362/103 |
| 2009/0272013 | A1* | 11/2009 | Beers et al. | 36/137 |
| 2009/0288317 | A1* | 11/2009 | Forbes | 36/136 |
| 2011/0170311 | A1* | 7/2011 | Reuben | 362/554 |
| 2011/0308114 | A1* | 12/2011 | Guzman | 36/137 |

* cited by examiner

LIGHTED FOOTWEAR

CROSS-REFERENCE TO RELATED APPLICATION

Benefit of U.S. Provisional Patent Application Ser. No. 61/484,172, entitled "Lighted Wading Boots," filed May 9, 2011, which is incorporated herein by reference, is hereby claimed.

BACKGROUND OF THE INVENTION

Field of the Invention

This invention relates generally to footwear, more particularly to lighted footwear, and specifically to footwear having a light to illuminate obstacles for a wearer.

Description of the Prior Art

Tripping hazards are always an issue in dark situations. Such difficulties are amplified in muddy situations. Flashlights are useful in such situations for identifying obstacles, but they occupy a user's hand and attention, leaving only one hand for the user to handle or carry something else. Headlamps are one known solution for such situations, but it may be difficult for a user to properly transition the light up and down to spot obstacles. For example, transitioning from looking up and down, non-stop, may become not only bothersome, but also somewhat disorienting.

SUMMARY

The present invention is directed to systems and methods, which provide lighted footwear having a light disposed at a top portion of an upper of the footwear to shine downward ahead of a toe of the footwear. For example, in lighted rubberized wading boots, at least one boot of a pair of rubberized waders has a light disposed at a top portion of an upper of the boot. This light is disposed to shine downward, ahead of a toe of the boot. The light may be one or more Light Emitting Diodes (LEDs) and/or may be disposed in a waterproof light housing molded into a top portion of the upper of the wading boot, such as at a top cuff of the wading boot. Such lighted waders may be insulated.

A waterproof battery compartment may be molded into the top portion of the upper of the wading boot, such as at a top cuff of the wading boot. This battery compartment may be separate from, and spaced apart from, the light housing. One or more batteries in the compartment are operatively coupled to the light, to power the light. For example, a switch may be operatively coupled to the battery and the light, such as in a circuit between the battery and the light to control operation of the light. This switch may be disposed in a waterproof switch housing, also molded into a top portion of the upper of the wading boot, such as at the top cuff of the wading boot. The light may have multiple settings, which might be controlled by the switch. Such settings might control intensity, an angle (high-beam/low beam), frequency/color, or other characteristic(s) of the light.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and specific embodiment(s) disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

Figure 1:
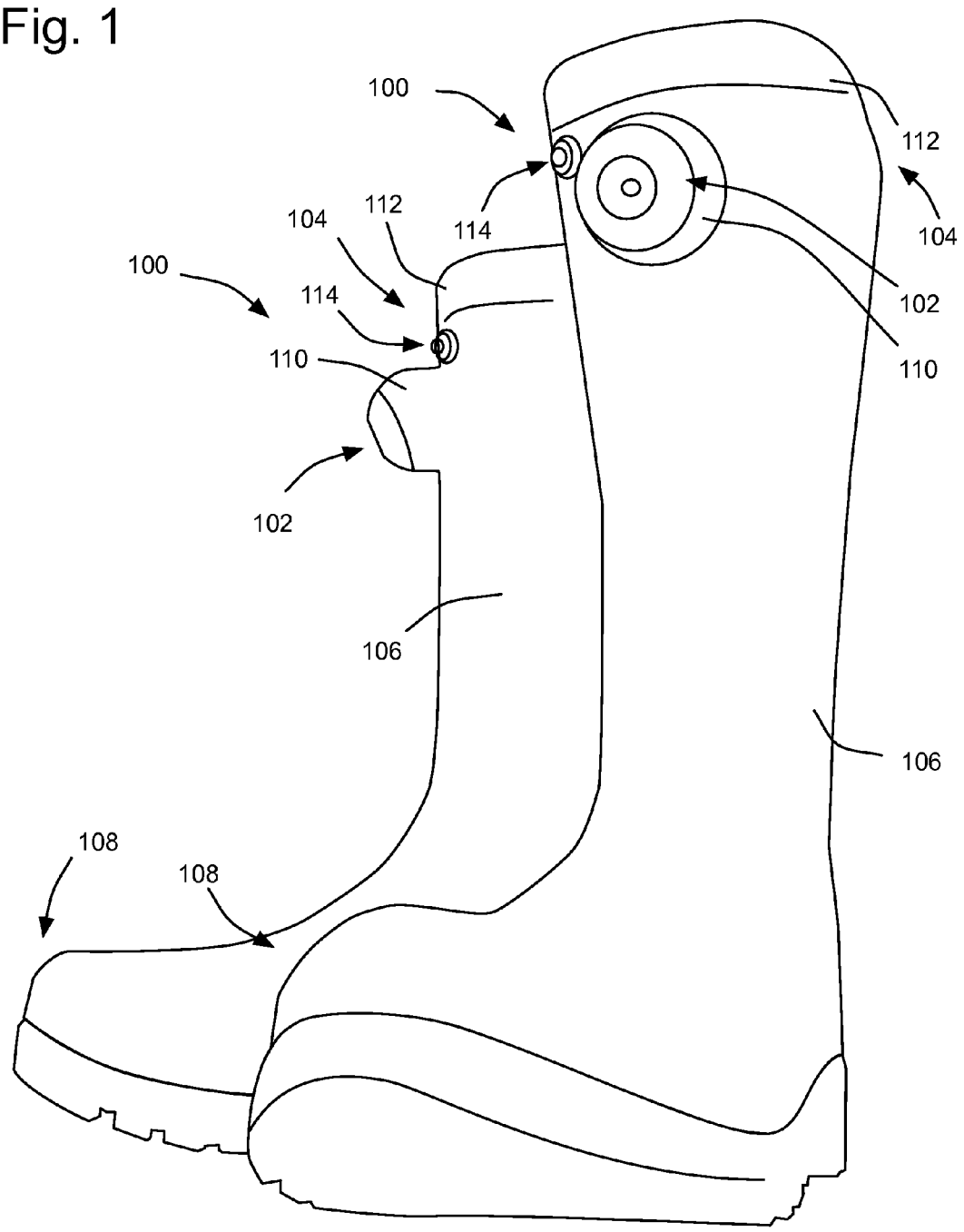
FIG. 1 is a front perspective view of a pair of lighted waders, in accordance with one embodiment.
Figure 2:
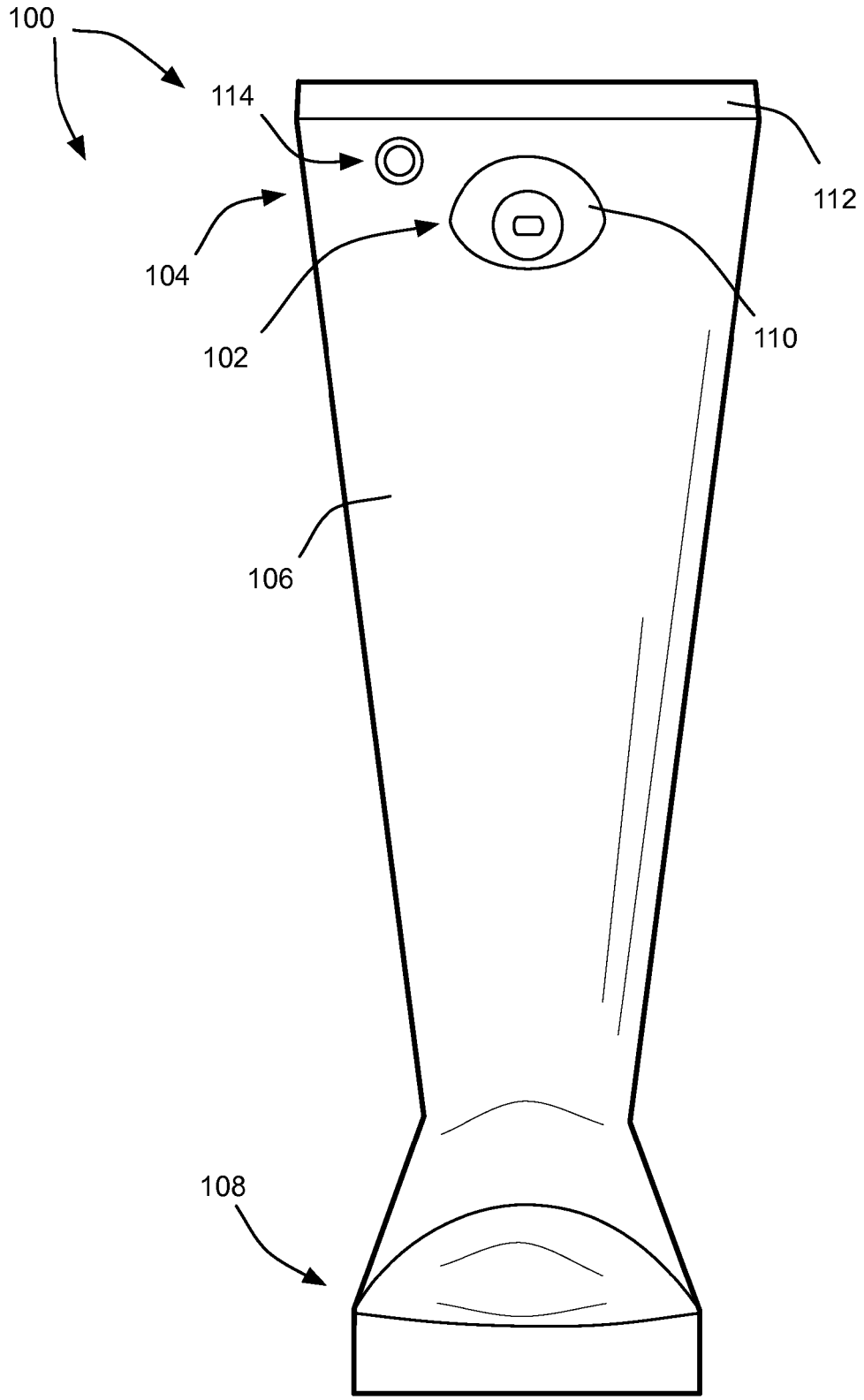
FIG. 2 is a front view of a lighted wader in accordance with one embodiment.

As noted, the present invention is direct to lighted footwear, and specifically to footwear having a light to illuminate obstacles for a wearer. As but one example, FIG. 1 is a perspective view of a pair of lighted wading boots 100, in accordance with one embodiment, while FIG. 2 is a front view of one lighted wader 100, in accordance with one embodiment. In these illustrated examples at least one wader 100 of a pair of rubberized waders has light 102 disposed at top portion 104 of upper 106 of boot 100. Such a rubber wading boot may be adapted for wading through water, mud, snow, etc., and made of a synthetic rubber material, silicone, or the like, so as to keep the users feet dry when in use. Light 102 is disposed to shine downward, ahead of toe 108 of boot 100. In accordance with various embodiments, each boot 100 has a light and embodiments of such lighted waders may be insulated such as by inclusion of an insulating lining layer for cold weather use, while non-insulated embodiments may be used in warm weather.

Figure 3:
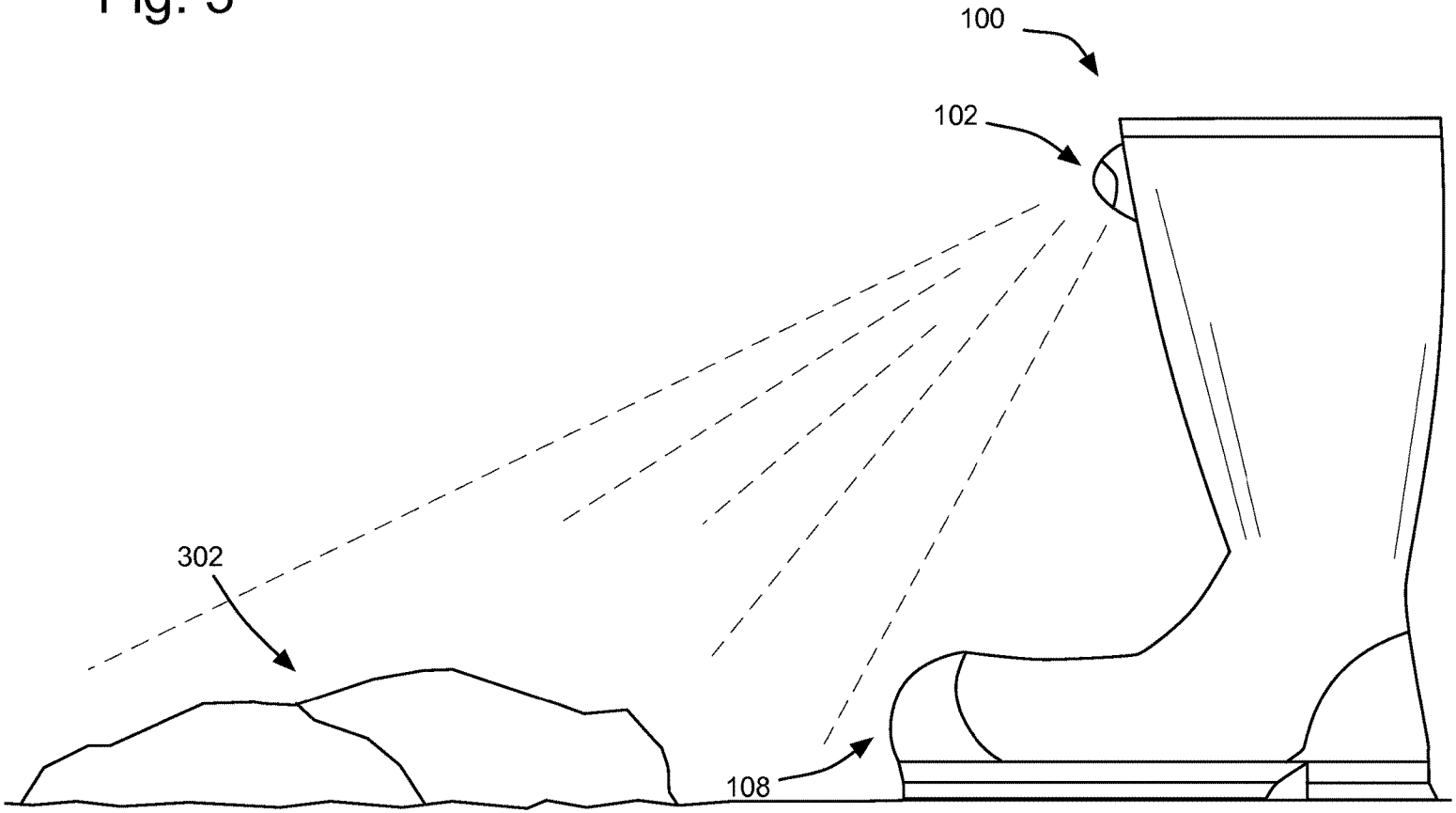
FIG. 3 is a side, environmental view of a lighted wader, in accordance with one embodiment.

Light 102 may be one or more LEDs, as discussed in greater detail below. LEDs may provide superior lighting, while maximizing battery life. Regardless, light 102 may be disposed in waterproof light housing 110 molded into top portion 104 of upper 106 of wading boot 100, such as at top cuff 112 of the wading boot, as shown. Thus, in one embodiment, the present lighted footwear is a rubber wading boot w/LED lights built into the upper area near the top of the boot. That is, the top forward portion of each boot 100 (i.e. near the wearer's knee) contains light source 102 having a focused beam of light, such as an LED. Various embodiments may have a more compact, slim and/or sleek light housing, so as to not protrude as far out as shown in the drawings. Regardless, light 102 shines a beam that allows the wearer to see directly in front of his boot. This will guide the user in hopes of avoiding any low-lying hazards that may exist. For example, FIG. 3 is a side, environmental view of lighted wader 100, in accordance with one embodiment, which shows boot 100 lighting obstacle 302.

Figure 4:
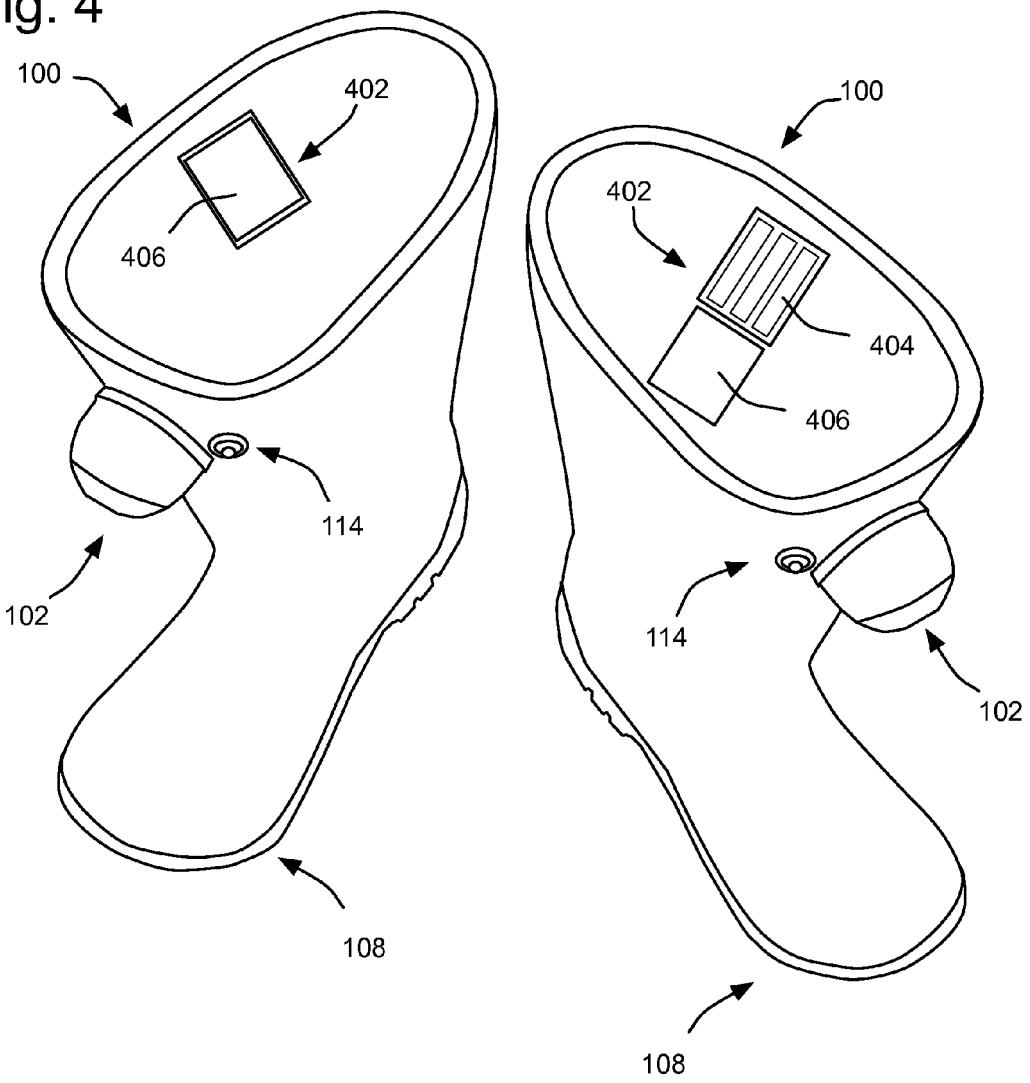
FIG. 4 is a top perspective view of a pair of lighted waders, in accordance with one embodiment.

FIG. 4 is a top perspective view of a pair of lighted waders, in accordance with one embodiment, which shows an example waterproof battery compartment 402 molded into top portion 104 of upper 106 of wading boot 100, namely, at top cuff 112 of wading boot 100. Battery compartment 402 may be waterproof, and it may be fixed to the upper inside portion of boot 100, as shown in FIG. 4. For example, battery pack 402 may be recessed/offset toward the inside of boot 100, as shown. The one or more batteries 404 in battery compartment 402 are operatively coupled to light 102 to power light 102, as discussed in greater detail below with respect to the schematic shown in FIG. 5. Battery compartment 402 may be separate from, and spaced apart from, light housing 110, as shown in FIG. 4. This may facilitate a slim light housing that does not protrude too far out. However, in accordance with some embodiments, the light housing may be integral with the battery compartment (e.g. the battery compartment might be a part of the light housing in such embodiments). In accordance with various embodiments, battery compartment 402 may be accessible to interchange standard and/or reusable batteries therein for continued use of boot(s) 100, such as via battery compartment door 406, shown removed in the left boot of FIG. 4.

Returning to FIGS. 1 through 4, switch 114 may be operatively coupled to the battery and light 102, such as in a circuit between the battery and light 102 to control operation of the light, as discussed in greater detail below with respect to the schematic shown in FIG. 5. Switch 114 may be disposed in waterproof switch housing, also molded into top portion 104 of upper 106 of wading boot 100, such as at top cuff 112 of wading boot 100. Switch 114 may be an off/on push button switch, or a multifunction button or switch, which may operatively select different intensities of light, angles and/or different colors/frequencies of light. For example, switch 114 may be used to select a red light that helps to preserve a user's night vision while providing sufficient illumination to light obstacles 302, or infrared light that may be used in Night Vision Goggle (NVG) operations as discussed below. Intensity and/or angle of the light might be selected to provide a low/high beam sort of control, which may selectively provide more intense light near the wearer's toe 108 and/or broader more diffused light further ahead. All wiring between switch 114, light 102 and battery compartment 402 may be incased and waterproof, in various embodiments.

The present boots may prove useful to hunters, fishermen, rescue workers, construction workers, military personnel, and various other personnel, as well as general consumers. As but one example, the present boots may help soldiers during NVG operations. Soldiers walking with NVGs and typical rubber wading boots may trip, fall into holes, and bump into things because of the limited range of vision afforded by NVGs, or because there is not enough ambient light available for proper operation of the NVGs. In such cases infrared light that only the NV's can detect may be used to light the way. In accordance with various embodiments, this infrared light may be provided by light 102 of the present boot(s). As a further example, hunters can use the present boots to navigate through wooded terrain, or the like, carrying their weapon, equipment, and/or game, without handling a flashlight. Headlamps can be used in conjunction with the present lighted boots to minimize up and down head movements, while opening up a persons viewing field and making hazards more visible. Use of the present boots may enable fishermen to wade through the water and be able to view their walking path underneath the water and/or facilitating walking across rocky jetties or similar terrain, while being able to see with each step.

Figure 5:
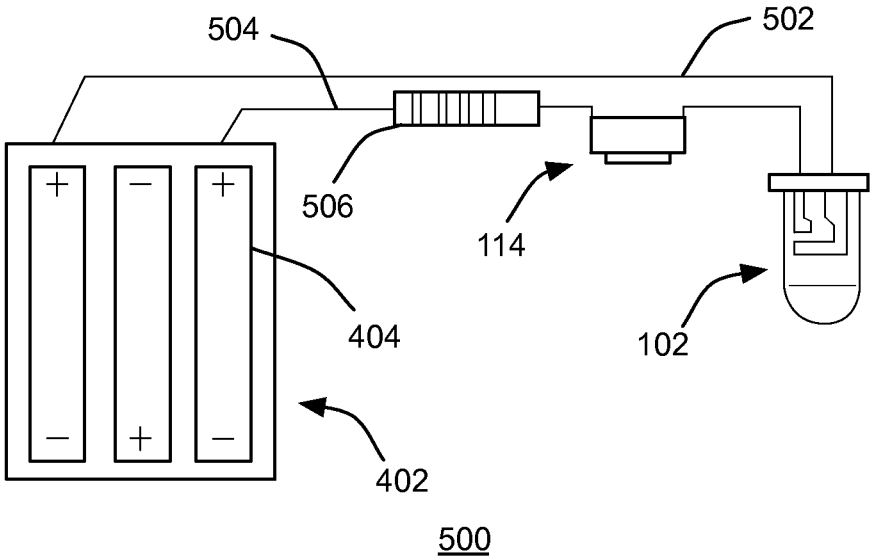
FIG. 5 is a diagrammatic schematic of an exemplar circuit for controlling operation of a light in lighted footwear, in accordance with one embodiment.

FIG. 5 is a diagrammatic schematic of exemplar circuit 500 for controlling operation of light 102 in lighted footwear 100, in accordance with one embodiment. As discussed above, power, such as in circuit 500 may be provided by one or more batteries 404 housed in battery compartment/pack 402. Batteries 404 are illustrated in FIG. 5 as one or more dry cell batteries, which could be disposable or rechargeable dry cells. However, batteries used to power light 102 may take any number of forms. For example, one or more "coin" cell, generally disk shaped, batteries might be used to power light 102, in place of the illustrated generally cylindrical dry cells, particularly if light 102 is a LED, such as illustrated in FIG. 5. Wiring 502, 504 may couple battery/power supply 402 to switch 114, and therethrough, to light 102. For example, wire 502 may extend from a negative terminal of battery/power supply 402 to cathode of LED light 102, while wire 504, connected to a positive terminal of battery/power supply 402, may couple illustrated resistor 506, switch 114 and an anode of LED 102, respectively, in series, as shown in FIG. 5. As noted above, wiring 502, 504 may be incased and waterproof, in various embodiments. As also noted above, switch 114 may be an off/on push button switch, or a multifunction button or switch which may operatively select different intensities of light, angles and/or different colors/frequencies of light to be shone by light 102. Thus, switch 114 may control not only the flow of current to light 102, but also the voltage or current level and/or which of a number of different LEDs making up light 102 are powered. Hence, light 102, may be a multi-frequency LED, or an LED array (of two or more LEDs having different frequencies, angular dispositions, and/or intensities).

While, the present lighted footwear has been described in language specific to structural features and/or methodological operations or actions, it is understood that the implementations defined in the appended claims are not necessarily limited to the specific features or actions described. Rather, the specific features and operations are disclosed as exemplary forms of implementing the claimed subject matter. For example, the light housing and battery compartment are variously described above and illustrated in embodiments shown in the drawings as molded into the footwear. However, the light housing, battery compartment and/or other elements may be molded onto the footwear, or otherwise affixed or secured on the footwear in accordance with various embodiments. Yet such components may remain waterproof, water resistant, or at least weather resistant.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. Lighted footwear comprising:

at least one footwear of a pair of footwear; and a light disposed in a top portion of an upper of said footwear, said light directed to shine a focused beam of light downward ahead of a toe of said footwear.

2. The lighted footwear of claim 1, wherein said at least one footwear is a boot, and said light disposed in said top portion of said upper is disposed in a top cuff of said boot.

3. The lighted footwear of claim 2, wherein said boot is a rubberized wading boot.

4. The lighted footwear of claim 3, wherein said rubberized wading boot is insulated.

5. The lighted footwear of claim 1, wherein said light comprises one or more light emitting diodes, emitting light of one or more frequencies, colors or intensities and at one or more selected angles.

6. The lighted footwear of claim 1, further comprising a battery compartment disposed in said top portion of said upper of said footwear, a battery therein operatively coupled to said light to power said light.

7. The lighted footwear of claim 6, wherein said battery compartment is separate from, and spaced apart from, said light.

8. The lighted footwear of claim 6, further comprising a switch disposed at said top portion of said upper of said footwear, operatively coupled to said battery and said light to control operation of said light.

9. The lighted footwear of claim 8, wherein said light comprises a light housing, and said light housing, said battery compartment, and a switch housing in which said switch is housed are waterproof and molded into said top portion of said upper of said footwear.

10. A lighted boot comprising:

at least one boot of a pair of boots; and a light disposed in a top cuff of said boot directed to shine a focused beam of light downward ahead of a toe of said boot.

11. The lighted boot of claim 10, wherein said boot is a rubberized wading boot.

12. The lighted boot of claim 10, wherein said boot is insulated.

13. The lighted boot of claim 10, wherein said light comprises one or more light emitting diodes, emitting light of one or more frequencies, colors or intensities, at one or more selected angles.

14. The lighted boot of claim 10, further comprising a battery compartment disposed in a top portion of said boot, a battery therein operatively coupled to said light to power said light.

15. The lighted boot of claim 14, wherein said battery compartment is separate from, and spaced apart from, said light.

16. The lighted boot of claim 14, further comprising a switch disposed at said top portion of said boot, operatively coupled to said battery and said light to control operation of said light.

17. The lighted boot of claim 16, wherein said light comprises a light housing, and said light housing, said battery compartment, and a switch housing in which said switch is housed are waterproof and molded into said top portion of said boot.

18. A lighted wading boot comprising:

at least one rubberized wading boot of a pair of rubberized wading boots;

one or more light emitting diodes, emitting light of one or more frequencies, colors or intensities, said one or more light emitting diodes disposed in a waterproof light housing molded into a top portion of an upper of said wading boot in a top cuff of said wading boot, said one or more light emitting diodes directed to shine a focused beam of light downward, ahead of a toe of said wading boot;

a waterproof battery compartment molded into said top portion of said upper of said wading boot, in said top cuff of said wading boot, a battery therein operatively coupled to said one or more light emitting diodes to power said one or more light emitting diodes; and a switch disposed in a waterproof switch housing molded into said top portion of said upper of said wading boot in said top cuff of said wading boot, operatively coupled to said battery and said one or more light emitting diodes to control operation of said one or more light emitting diodes.

19. The lighted wading boot of claim 18, wherein said battery compartment is separate from, and spaced apart from, said light housing.

20. The lighted wading boot of claim 18, wherein said rubberized wading boots are insulated.

* * * * *